US009388610B2

(12) United States Patent
Lee et al.

(10) Patent No.: US 9,388,610 B2
(45) Date of Patent: Jul. 12, 2016

(54) DOOR LATCH ASSEMBLY OF VEHICLE

(71) Applicants: Hyundai Motor Company, Seoul (KR); PYEONG HWA AUTOMOTIVE CO., LTD., Dalseo-gu, Daegu (KR)

(72) Inventors: Sang Hyun Lee, Jeju-si (KR); Jong Cheol Oh, Daegu (KR)

(73) Assignees: HYUNDAI MOTOR COMPANY, Seoul (KR); PYEONG HWA AUTOMOTIVE CO., LTD., Dalseo-Gu, Daegu (KR)

( * ) Notice: Subject to any disclaimer, the term of this patent is extended or adjusted under 35 U.S.C. 154(b) by 0 days.

(21) Appl. No.: 14/852,447

(22) Filed: Sep. 11, 2015

(65) Prior Publication Data

US 2016/0115718 A1 Apr. 28, 2016

(30) Foreign Application Priority Data

Oct. 28, 2014 (KR) ..... 10-2014-0147141

(51) Int. Cl.

| | |
|---|---|
| ***E05C 3/16*** | (2006.01) |
| ***E05C 3/34*** | (2006.01) |
| ***E05C 3/38*** | (2006.01) |
| ***E05B 79/06*** | (2014.01) |
| ***E05B 79/08*** | (2014.01) |
| ***E05B 85/10*** | (2014.01) |
| ***E05B 85/24*** | (2014.01) |

(52) U.S. Cl.

CPC . *E05C 3/16* (2013.01); *E05B 79/06* (2013.01); *E05B 79/08* (2013.01); *E05B 85/10* (2013.01); *E05B 85/243* (2013.01); *E05C 3/34* (2013.01); *E05C 3/38* (2013.01)

(58) Field of Classification Search

CPC ..... E05C 3/16; E05C 3/34; E05C 3/38; E05C 79/06; E05C 79/08; E05C 85/10; E05C 85/243; Y10T 292/083; Y10T 292/0826; Y10T 292/1047

See application file for complete search history.

(56) References Cited

U.S. PATENT DOCUMENTS

| | | | | |
|---|---|---|---|---|
| 4,073,515 | A * | 2/1978 | Perera | F16L 41/12 137/318 |
| 5,738,394 | A * | 4/1998 | Arabia, Jr. | E05B 77/265 292/216 |
| 6,305,727 | B1 * | 10/2001 | Bland | E05B 85/243 292/216 |
| 6,651,467 | B1 * | 11/2003 | Weinerman | E05B 5/00 292/216 |
| 2006/0186676 | A1 * | 8/2006 | Fukunaga | E05B 81/06 292/216 |

(Continued)

FOREIGN PATENT DOCUMENTS

| | | | |
|---|---|---|---|
| JP | 2001-241245 | A | 9/2001 |
| KR | 10-2006-0067232 | A | 6/2006 |

(Continued)

*Primary Examiner* — Daniel Rohrhoff

(74) *Attorney, Agent, or Firm* — McDermott Will & Emery LLP

(57) ABSTRACT

A door latch assembly of a vehicle includes an outer handle lever connected to a door outside handle. An opening lever is configured to pivot in a door opening direction when the outer handle lever pivots. A pawl lever is coaxially connected to the opening lever and configured to pivot with the opening lever in the door opening direction in a door unlocked state. A door locking and unlocking device is configured to pivot the opening lever and the pawl lever in the door unlocked state in the door opening direction. A claw lever is restricted by the pawl lever to lock a striker when the door is locked and is released from the pawl lever to release the striker when the door is opened.

13 Claims, 12 Drawing Sheets

(56) References Cited

U.S. PATENT DOCUMENTS

| | | | | |
|---|---|---|---|---|
| 2007/0040391 | A1* | 2/2007 | Fujihara | E05B 81/20 292/201 |
| 2008/0073915 | A1* | 3/2008 | Hunt | E05B 81/06 292/201 |
| 2010/0320777 | A1* | 12/2010 | Jankowski | E05B 77/06 292/200 |
| 2014/0346786 | A1* | 11/2014 | Takagi | E05B 77/06 292/200 |
| 2015/0123407 | A1* | 5/2015 | Wilkes | B60J 5/00 292/97 |
| 2015/0315824 | A1* | 11/2015 | Gotzen | E05B 77/06 292/200 |

FOREIGN PATENT DOCUMENTS

| | | | |
|---|---|---|---|
| KR | 10-0828440 | B1 | 5/2008 |
| KR | 10-2008-0107806 | A | 12/2008 |
| KR | 10-2010-0002626 | A | 1/2010 |
| KR | 10-2011-0096304 | A | 8/2011 |
| KR | 10-2011-0135548 | A | 12/2011 |
| KR | 10-1255562 | B1 | 4/2013 |

* cited by examiner

- Door locked state -

- Door unlocked state -

- Door unlocked state -

- Door locked state -

- Door locked state -

- Door unlocked state -

- Door unlocked state -

DOOR LATCH ASSEMBLY OF VEHICLE

CROSS-REFERENCE TO RELATED APPLICATION

This application claims under 35 U. S. C. §119(a) the benefit of priority to Korean Patent Application No. 10-2014-0147141 filed on Oct. 28, 2014, the entire contents of which are incorporated herein by reference.

TECHNICAL FIELD

The present invention relates to a door latch assembly of a vehicle. More particularly, it relates to a door latch assembly of a vehicle for preventing a door from being opened as an outside handle is pulled in an opening direction by an inertial force at a side collision.

BACKGROUND

As known well, an outside handle is mounted outside a door and an inside handle is mounted inside the door, for the opening and closing of a door of a vehicle, while a door latch assembly locked and released by a device such as a remote controller, a key, and the like is mounted inside a door panel.

Thus, when a user manipulates an opening button of a remote controller to open a door normally, a solenoid of a door latch assembly received with a signal from the remote controller moves in an opening direction of the door such that releasing of the door latch is carried out and then a user pulls the door outside handle in the opening direction so that the door is opened.

Hereinafter, configuration and operations of an existing door latch assembly of a vehicle will be described.

FIGS. 1 and 2 are a perspective view and a side view showing a locked state of an existing door latch assembly, and FIGS. 3 and 4 are a perspective view and a side view showing an unlocked state of the existing door latch assembly, respectively.

As shown in FIGS. 1 to 4, a reference numeral '100' indicates an outer handle lever associated with a door outside handle.

The outer handle lever 100 is disposed outside in the width direction of the door panel and is connected with an outside handle (not shown) by a cable 102. By doing so, the cable 102 is pulled simultaneously with as the outside handle is pulled so that the outer handle lever 100 is pivoted in the opening direction.

To this end, the outer handle lever 100 is configured about a rotation center such that the cable 102 is connected to an end of the outer handle lever 100 and an operating pin 104 integrally protrudes from the other end of the outer handle lever 100 to operate a first opening lever 120.

In this case, the first opening lever 120, a second opening lever 130, and a pawl lever 140 are coaxially connected close by the outer handle lever 100 to pivot.

The first opening lever 120 is configured such that an opening lever operating end 122 is formed in the lower side from a rotation center thereof to bring a contact with the operating pin 104 and that a first slot 124, into which a lower side of a locking linkage 160 is inserted to ascend and descend, is formed close by the opening lever operating end 122.

Around a rotary shaft of the first opening lever 120, a first return spring 126 is mounted to return the first opening lever 120 to its original position after pivoting in the opening direction.

The second opening lever 130 is coaxially connected to the first opening lever 120 while pivoting independently from the first opening lever 120, such that a lower side thereof lower than a rotation center is formed with a second slot 132 matched with the first slot 124 of the first opening lever 120 and having a length shorter than that of the first slot 124.

The door is unlocked when the lower end of the locking linkage 160 is inserted into the first slot 124 of the first opening lever 120 and the second slot 132 of the second opening lever 130 simultaneously, while the door is locked when the lower end of the locking linkage 160 escapes from the second slot 132 of the second opening lever 130 but is inserted into only the first slot 124 of the first opening lever 120.

The pawl lever 140 is coaxially connected to the second opening lever 130 to pivot simultaneously with the second opening lever 130 such that a pawl 142 integrally protrudes from the upper side above the rotation center thereof.

A claw lever 150 is pivotally disposed above the pawl lever 140 to restrict a striker when a door is closed and to release the striker when the door is opened.

A claw 152 integrally protrudes from the lower side of the claw lever 160 such that the claw lever 150 is caught by the pawl 142 of the pawl lever 140 and then does not pivot in the door opening direction. A striker restricting slot 154 is formed at the directly side of the claw 152 such that a striker 110 integrally formed on a door side frame is inserted thereinto.

Moreover, a second return spring 156 is mounted around a rotation shaft of the claw lever 150, so that the second return spring 156 provides a resilient force enabling the claw lever 150 to pivot in the opening direction.

A locking lever 170 is mounted on the door panel and is pivoted by an actuator for a door lock (a state that the door is not open even when the door outside handle or the door inside handle is operated in the door opening direction) and a door unlock (a state that the door may be open when the door outside handle or the door inside handle is operated in the door opening direction).

The locking lever 170 pivots in the door locking direction by a driven actuator when a driver turns a door lock selection switch on and pivots in the door unlocking direction by a driven actuator when the driver turns a door release switch on.

In this case, a third slot 172 is formed in a side from the rotation shaft of the locking lever 170 to lift and lower the locking linkage 160.

Then, the lower end of the locking linkage 160 is inserted into the first slot 124 of the first opening lever 120 and the second slot 132 of the second opening lever 130 to ascend and descend, while the upper end thereof is inserted into the third slot 172 of the locking lever 170 through a hinge pin to ascend and descend.

An inside handle lever associated with an inside handle to open and close the door in the compartment is not shown in the drawings.

Here, operations of the existing door latch assembly as described above will be described.

Door Locked State

FIGS. 1 and 2 show a locked state of the existing door latch assembly.

The door locked state means a state that a door is not opened even when a user manipulates the outside handle or the inside handle in the door opening direction.

To this end, when a driver turns the door lock switch on, the locking lever 170 lowers the locking linkage 160 as being pivoted in the door locking direction by a driven actuator.

In this case, the upper end of the locking linkage 160 is positioned on the upper side of the third slot 172 of the locking lever 170 and at the same time, the lower end thereof is escaped from the second slot 132 of the second opening lever 130 but is inserted into only the first slot 124 of the first opening lever 120.

Thus, the door outside handle is pulled in the opening direction and the cable 102 is pulled from the outside of a vehicle, so that, as shown in FIG. 2 showing a state after operation, the outer handle lever 100 connected to the cable 102 pivots in the opening direction.

At the same time, when the outer handle lever 100 pivots in the opening direction (clockwise), the operating pin 104 of the outer handle lever 100 pivots the first opening lever 120 in the opening direction (counterclockwise).

In this case, when the first opening lever 120 is pushed by the operating pin 104 and pivots in the opening direction (counterclockwise), since the lower end of the locking linkage 160 escapes from the second slot 132 of the second opening lever 130 and is inserted into only the first slot 124 of the first opening lever 120, the hinge pin at the lower end of the locking linkage 160 pivots with the first opening lever 120 but does not pivot the second opening lever 130.

Thus, the second opening lever 130 and the pawl lever 140, which must be operated to open the door, do not pivot and as shown in FIG. 5 the claw 152 of the claw lever 150 is caught and restricted by the pawl 142 of the pawl lever 140, so that the door may be prevented from being opened even by manipulating the door outside handle in the door locked state.

Door Unlocked State

FIGS. 3 and 4 show an unlocked state of the existing door latch assembly.

The door unlocked state means that the door is opened when a user manipulates the door outside handle or the door inside handle in the opening direction.

To this end, when a driver turns the door lock switch off, the locking lever 170 lifts the locking linkage 160 as being pivoted in the door unlocking direction by a driven actuator.

In this case, the upper end of the locking linkage 160 is positioned on the lower side of the third slot 172 of the locking lever 170 as the locking linkage 160 ascends and at the same time, the lower end thereof is inserted into the first slot 124 of the first opening lever 120 and the second slot 132 of the second opening lever 130.

Thus, the door outside handle is pulled in the opening direction and the cable 102 is pulled from the outside of a vehicle, so that, as shown in FIG. 4 showing a state after operation, the outer handle lever 100 connected to the cable 102 pivots in the opening direction.

At the same time, when the outer handle lever 100 pivots in the opening direction (clockwise), the operating pin 104 of the outer handle lever 100 pivots the first opening lever 120 in the opening direction (counterclockwise).

In this case, when the first opening lever 120 is pushed by the operating pin 104 and pivots in the opening direction (counterclockwise), since the lower end of the locking linkage 160 is inserted into the first slot 124 of the first opening lever 120 and the second slot 132 of the second opening lever 130, the hinge pin at the lower end of the locking linkage 160 pivots with the first opening lever 120 and the second opening lever 130.

Moreover, the pawl lever 140 pivotally and coaxially connected to pivot with the second opening lever 130 pivots with the second opening lever 130 in the opening direction.

Next, the pawl 142 climbs over the claw 152 of the claw lever 150 as the pawl lever 140 pivots so that the claw 152 is released. At the same time, the claw lever 150 pivots in the door opening direction due to the second return spring 156 so that the striker restricting slot 154 of the claw lever 150 is opened inward to allow the door.

Thus, when a user who is outside a vehicle continues to pull the door outside handle in the opening direction, the striker 110 integrally formed with the door side frame escapes from the striker restricting slot 154 of the claw lever 150 such that the door is opened.

However, the existing door latch assembly has following drawbacks.

At the side collision of a door of a vehicle, when an inertial force is applied to the door outside handle such that the outside handle is pulled in the opening direction or that the outer handle lever connected to the door outside handle is pivoted in the opening direction by an impact caused by the side collision, the door may be opened. If the door is opened at the side collision caused by the impact, a passenger may be catapulted out of the vehicle and he/she may be deadly injured.

In other words, at the side collision of a door of a vehicle, when an inertial force is applied to the door outside handle such that the outside handle is pulled in the opening direction or that the outer handle lever connected to the door outside handle is pivoted in the opening direction by an impact caused by the side collision, a process of opening a door from the door unlocked state is carried out identically so that the door may be opened. Furthermore, if the door is opened at the side collision caused by the impact, a passenger may be catapulted out of the vehicle and he/she may be deadly injured.

The reason of the door opening at the side collision is that the outer handle lever connected by the door outside handle and the cable is eccentrically disposed toward the outside than toward the inside, resulting in being easily affected by the side collision.

Then, a new door latch assembly for preventing a door from being opened even at the side collision is demanded.

SUMMARY

Accordingly, the present invention has been made in an effort to solve the above-mentioned problems, and it is an object of embodiments of the present invention to provide a door latch assembly of a vehicle in which an outer handle lever is eccentrically mounted to the inside in a door panel to minimize impact against the outer handle lever connected to an door outside handle at a side collision and in which structures of not only a linkage and a lever associably disposed between the outer handle lever and a pawl lever but the pawl lever and a claw lever are newly improved, so that a door may be prevented from being opening at the side collision.

In accordance with an aspect of the present invention, there is provided a door latch assembly of a vehicle including: an outer handle lever connected to a door outside handle by a cable and pivotally mounted in an inner position in a door panel; an opening lever pivotally disposed at an outer position relative to the outer handle lever substantially perpendicularly to the outer handle lever and configured to pivot in a door opening direction when the outer handle lever pivots; and a pawl lever coaxially connected to the opening lever and disposed at an outer position relative to the opening lever. The pawl lever is configured to pivot with the opening lever in the door opening direction in a door unlocked state. A door locking and unlocking device is pivotally disposed at an upper position relative to the opening lever and at an inner position relative to the pawl lever. The door locking and unlocking device is configured to pivot the opening lever and the pawl lever in the door unlocked state in the door opening direction. A claw lever is pivotally disposed at an upper position relative to the pawl lever and an outer position relative to the door locking and unlocking device. The door latch assembly also includes a striker. The claw lever is restricted by the pawl lever to lock the striker when the door is locked and is released from the pawl lever to release the striker when the door is opened.

In certain embodiments, the outer handle lever is disposed in a substantially utmost inner position in the door panel and is configured to pivot in the same direction as a width direction of the door panel.

In certain embodiments, the outer handle lever has opposing front and rear ends, the cable is connected to a rear end of the outer handle lever for the connection with the door outside handle and a pressing end configured to press an end of the opening lever down is integrally formed with the front end of the outer handle lever.

In certain embodiments, the door latch assembly further includes an inside handle, a first rotary shaft, and an inside handle lever. The outer handle lever may be configured to pivot about the first rotary shaft. The inside handle lever may be connected to the inside handle and coaxially connected to the first rotary shaft.

In certain embodiments, the opening lever is provided in the form of an "L"-shape about a second rotary shaft and includes a planar pressing end pressed by the outer handle lever integrally formed with an end of the opening lever and a door locking and unlocking slot formed in the lower side of the other end below second the rotary shaft.

In certain embodiments, the pawl lever is provided in the form of an "L"-shape about a third rotary shaft and is coaxially connected to the second rotary shaft. The pawl lever may have opposing first and second ends and may include a pawl integrally protruding from an upper side of the first end of the pawl lever and a door opening pushing-back end integrally extending from the second end of the pawl lever towards a lower side of the third rotary shaft The pawl may be configured to restrict a claw of the claw lever.

In certain embodiments, the opening lever has a door locking and unlocking slot formed therein and the pawl lever has a door opening pushing-back end extending in a length direction of the door locking and unlocking slot of the opening lever. In certain embodiments, the door locking and unlocking device includes a first locking lever configured to pivot in a door locking direction or in a door unlocking direction due to an actuator which is driven when a door lock switch is turned on or off. A second locking lever may be arranged substantially perpendicularly to the first locking lever. The second locking lever may have opposing first and second ends. The first end may be connected to the first locking lever, and the second end may have a locking linkage elevation range-restricting slot formed therein. The second locking lever may be configured to pivot with the first locking lever in the door opening direction to lock or unlock the door. A locking linkage may have an upper end connected to the second end of the second locking lever and a lower end inserted into the door locking and unlocking slot of the opening lever. The lower end may be configured to selectively contact the door opening pushing-back end of the pawl lever.

In certain embodiments, the first locking lever may have an upper end having a restricting recess formed therein. The first end of the second locking lever may be inserted into the restricting recess.

In certain embodiments, the locking linkage includes a first pin integrally formed with the upper end and inserted into the locking linkage elevation range-restricting slot and a second pin integrally formed with the lower end. The second pin may be inserted into the door locking and unlocking slot of the opening lever and may be configured to selectively contact the door opening pushing-back end of the pawl lever.

In certain embodiments, the door locking and unlocking slot of the opening lever may be longer than the door opening pushing-back end of the pawl lever.

In certain embodiments, the door latch assembly further includes a first return spring mounted between the opening lever and a latch housing to provide a resilient restoring force returning the opening lever toward its original position after the opening lever pivots in the door opening direction.

In certain embodiments, the door latch assembly further includes a second return spring mounted around a rotary shaft of the pawl lever to provide a resilient restoring force returning the pawl lever toward its original position after the pawl lever pivots in the door opening direction.

In certain embodiments, the door latch assembly further includes a third return spring mounted around a rotary shaft of the claw lever to provide a resilient restoring force pivoting the claw lever in the opposite direction of the door opening direction. The door latch assembly of a vehicle according to embodiments of the present invention may have the following effects.

First, in certain embodiments, the outer handle lever connected to the door outside handle is mounted at a position where the impact at the side collision is minimized, that is, at a substantially utmost inside position in the door panel such that the shock is not transferred, so that the outer handle lever may be prevented from pivoting in the door opening direction and being opened due to the impact and the inertial force at the side collision as in the existing door latch assembly.

Second, in certain embodiments, not only is the outer handle lever connected to the door outside handle mounted at the substantially utmost inside in the door panel but an opening lever, a pawl lever, a locking lever, and a locking linkage which are in association with the outer handle lever may be disposed as newly improved structures at the outside so that the door may be easily opened and closed in a door locked state and a door unlocked state.

Third, in certain embodiments, the outer handle lever connected to the door outside handle may be mounted at the substantially utmost inside in the door panel and the opening lever, the pawl lever, the locking lever, and the locking linkage, which are in association with the outer handle lever, may be overlapped with each other so that the shock at the side collision may be blocked from being transferred to the outer handle lever, resulting in preventing the door from being opened at the side collision.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
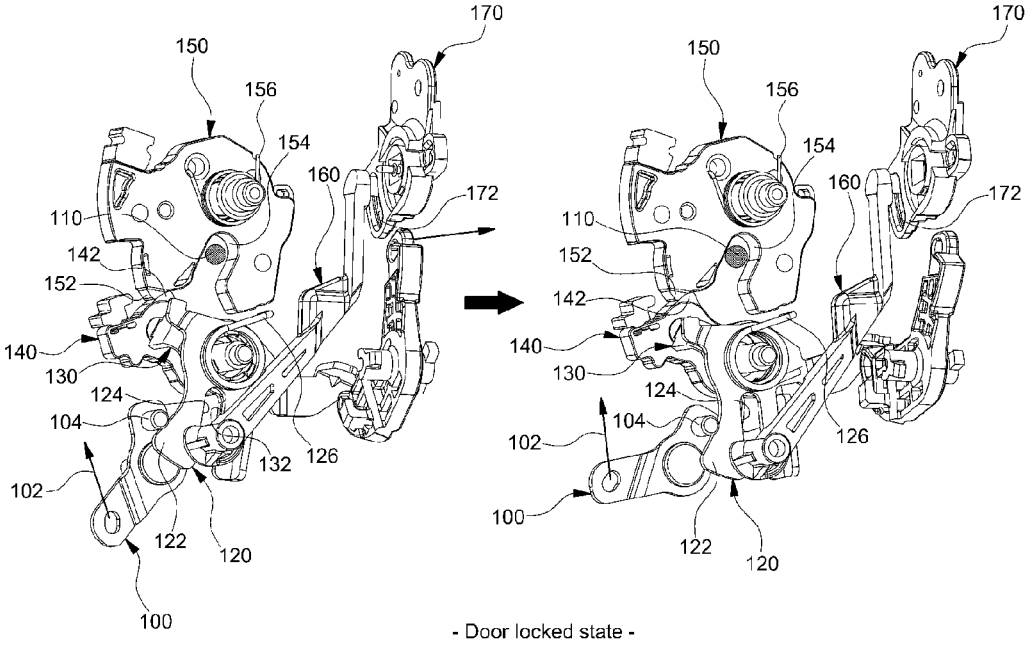
FIG.1 Related Art
FIGS. 1 and 2 are a perspective view and a side view showing a locked state of an existing door latch assembly respectively.
Figure 2:
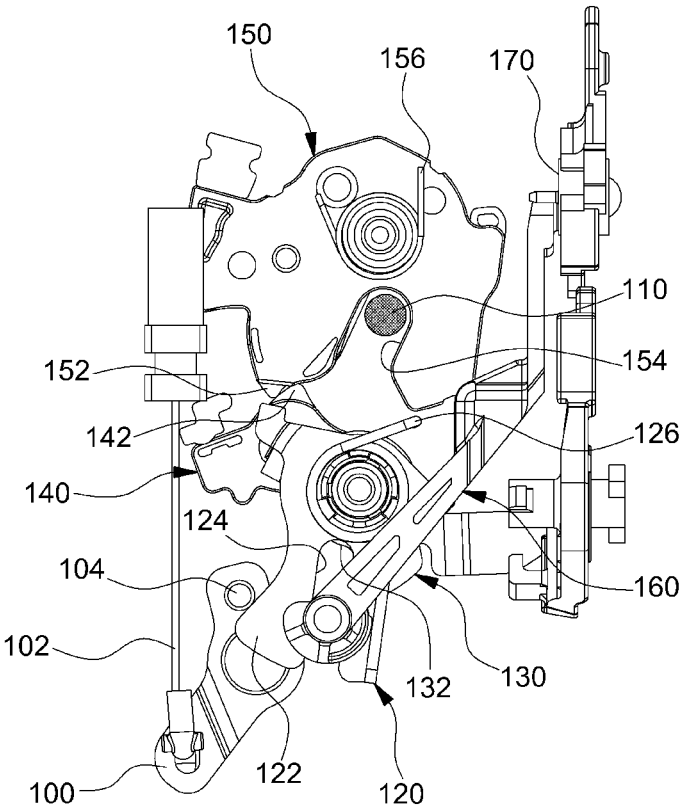
FIG.2 Related Art
Figure 3:
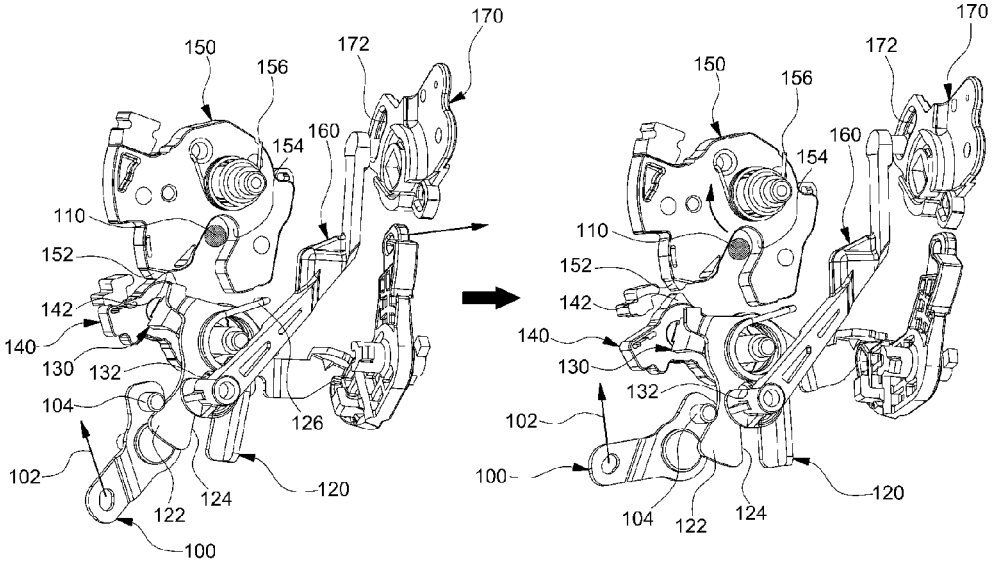
FIG.3 Related Art
FIGS. 3 and 4 are a perspective view and a side view showing an unlocked state of the existing door latch assembly.
Figure 4:
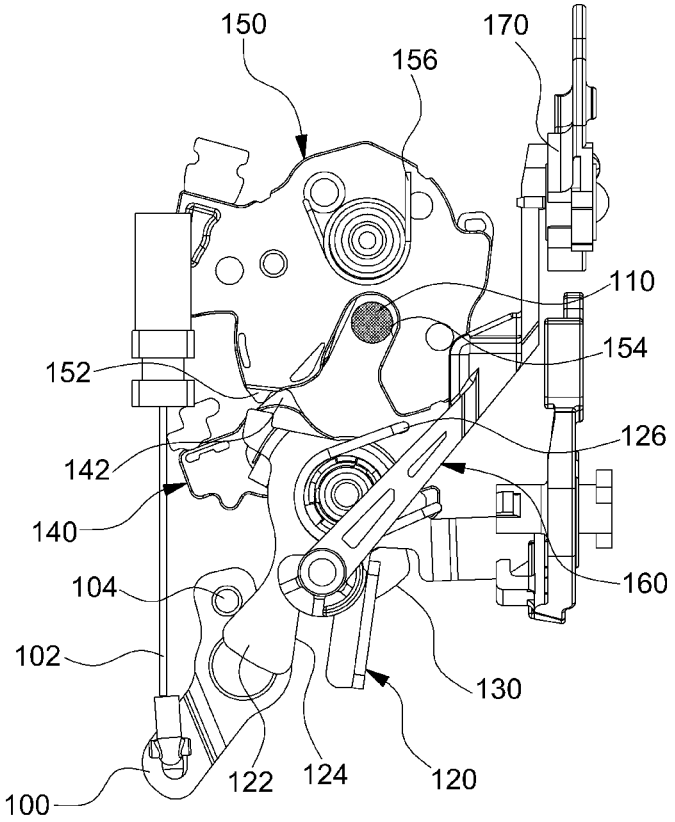
FIG.4 Related Art
Figure 5:
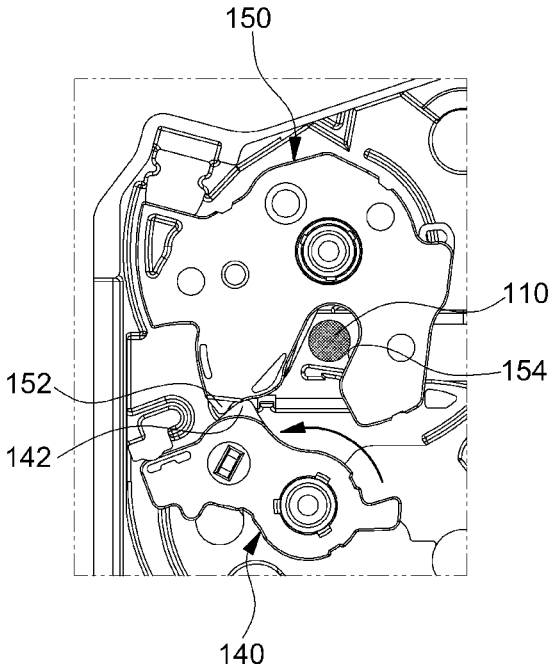
FIG.5 Related Art
FIG. 5 is a rear side view arrangement of a pawl lever and a claw lever of the existing door latch assembly.

It should be understood that the appended drawings are not necessarily to scale, presenting a somewhat simplified representation of various features illustrative of the basic principles of certain embodiments of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, the present invention will be described in detail so that those skilled in the art to which the present invention pertains can easily carry out embodiments of the present invention.

Figure 6:
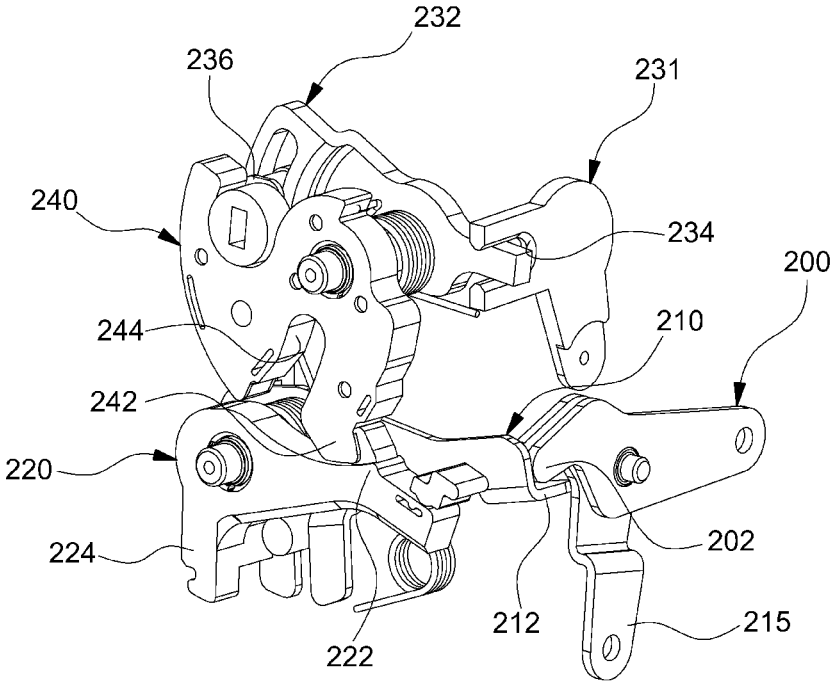
FIGS. 6 and 7 are perspective views showing a door latch assembly of a vehicle according to an embodiment of the present invention, respectively.
Figure 7:
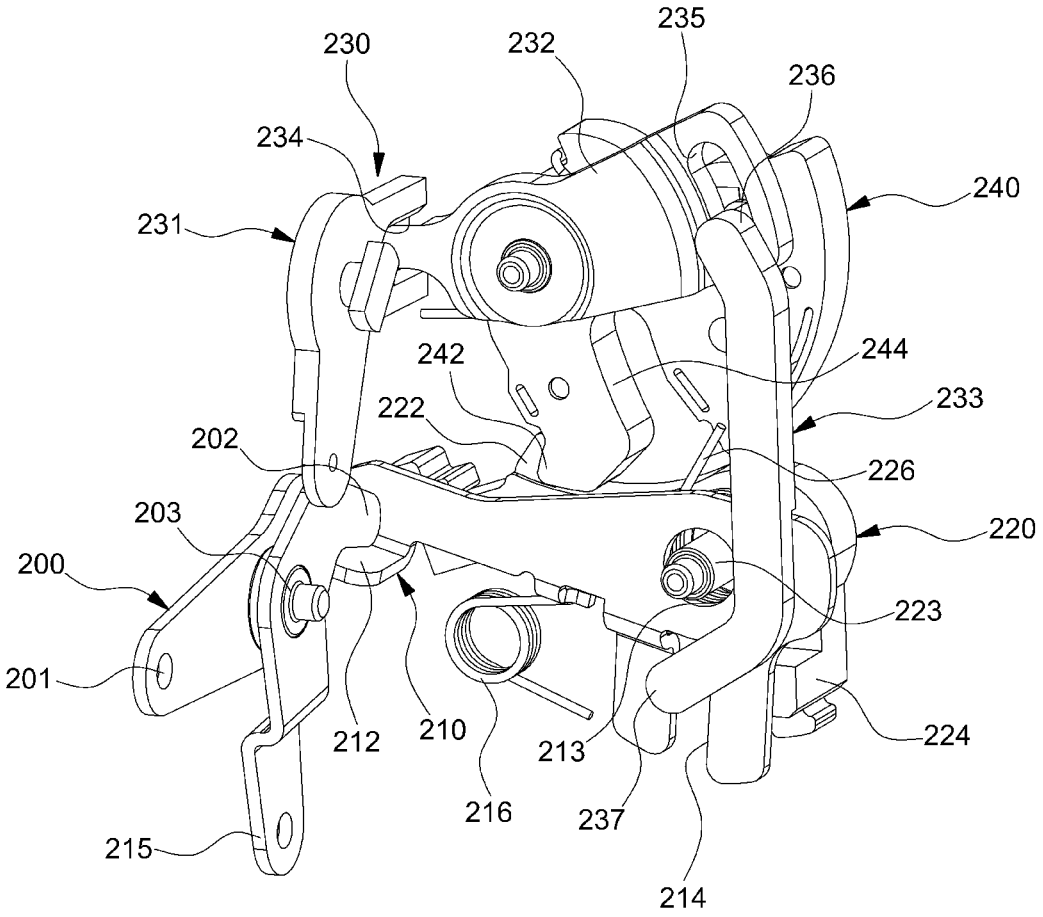
Figure 8:
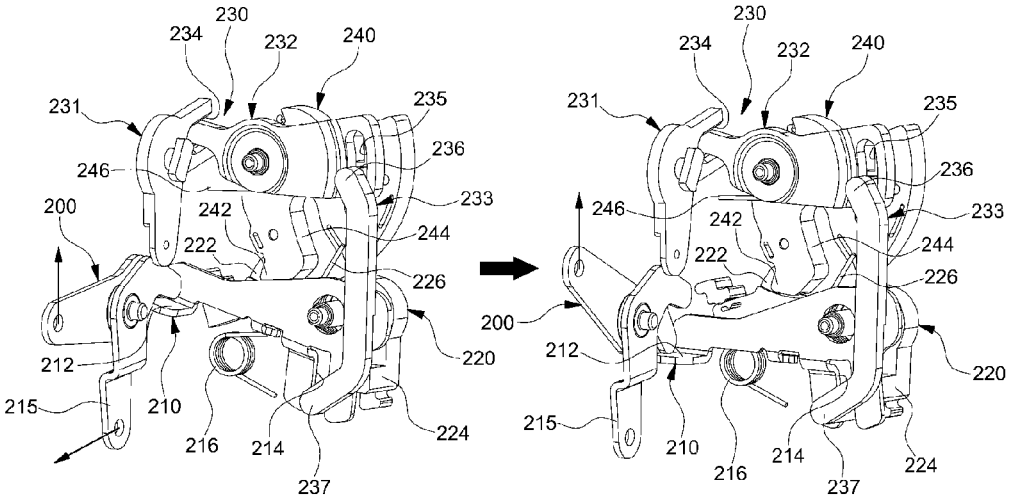
FIGS. 8 and 9 are a perspective view and a side view showing a locked state of the door latch assembly of a vehicle according to the embodiment of the present invention, respectively.
Figure 9:
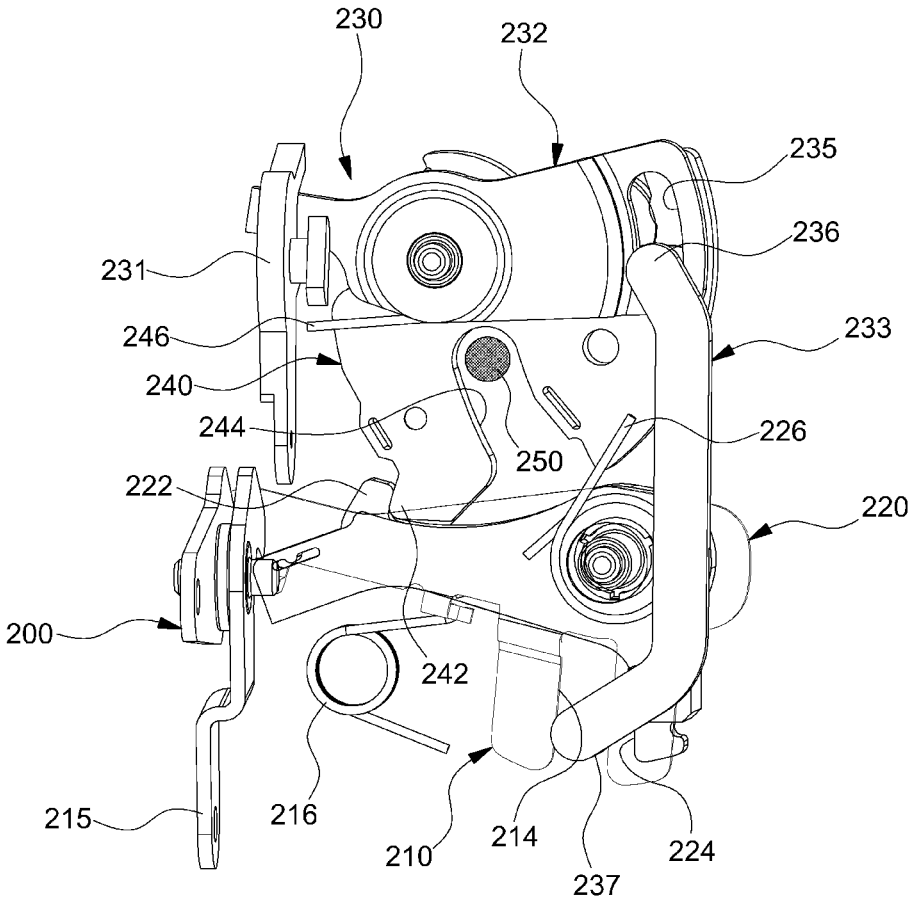
Figure 10:
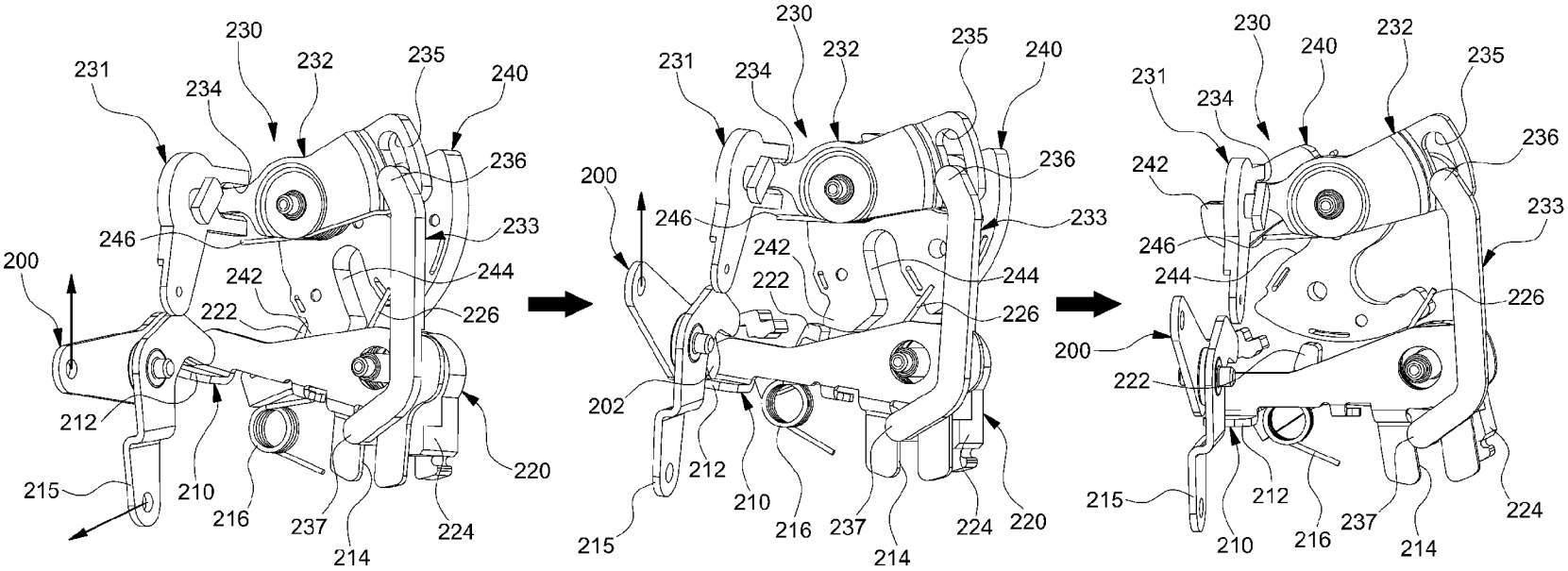
FIGS. 10 and 11 are a perspective view and a side view showing an unlocked state of the door latch assembly of a vehicle according to the embodiment of the present invention, respectively.
Figure 11:
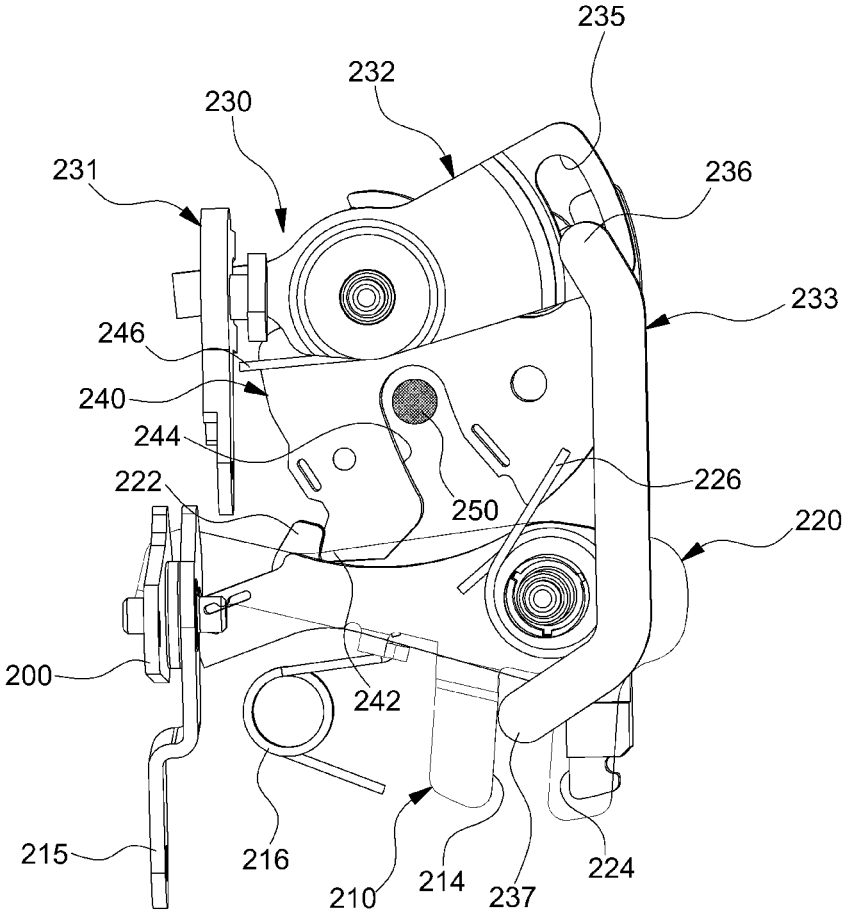

FIGS. 6 and 7 are perspective views showing a door latch assembly of a vehicle according to an embodiment of the present invention, respectively. FIGS. 8 and 9 are a perspective view and a side view showing a locked state of the door latch assembly of a vehicle according to the embodiment of the present invention, respectively. FIGS. 10 and 11 are a perspective view and a side view showing an unlocked state of the door latch assembly of a vehicle according to the embodiment of the present invention, respectively.

In FIGS. 6 to 11, a reference numeral '200' indicates an outer handle lever connected to a door outside handle (not shown).

In certain embodiments, the outer handle lever 200 is pivotally mounted in the utmost inner position in a door panel.

An advantage of the outer handle lever 200 being disposed in the utmost or substantially utmost inner position in the door panel is that the impact at the side collision may be minimized and a shock may not be transferred at the side collision so that the door may be prevented from being opened due to the side collision.

In certain embodiments, the outer handle lever 200 is pivotally mounted at the utmost inner position in a door panel in the same direction as the lateral direction of a door panel. In certain embodiments, the outer handle lever 200 may be configured to pivot about a first rotary shaft 203.

In certain embodiments, a rear end 201 of the outer handle lever 200 is connected to a cable for the connection with a door outside handle and a front end thereof is integrally formed with a pressing end 202 and pressing a planar pressing end 212 of an opening lever 210 down, causing the opening lever 210 to pivot in a door opening direction.

In certain embodiments, the opening lever 210 is disposed substantially perpendicular to the outer handle lever 200 in the longitudinal direction of the door panel at the outside position of the outer handle lever 200, such that the opening lever 210 pivots with the outer handle lever 200 in the door opening direction during the pivoting of the outer handle lever.

In certain embodiments, the opening lever 210 is provided in a "L" shape about a second rotary shaft 213, and includes the planar pressing end 212 integrally formed on an end of the opening lever 210 close to f the outer handle lever 200 and pressed down by the pressing end 202 of the outer handle lever 200 and a downwardly opened door locking and unlocking slot 214 at the other end of the opening lever 210 at the lower side of the second rotary shaft 213.

In certain embodiments, to the first rotary shaft 203 of the outer handle lever 200, an inside handle lever 215 connected to an inside handle (not shown) for a passenger in a vehicle to open and close a door is coaxially connected, and the inside handle lever 215 is configured to press the pressing end 212 of the opening lever 210 during the pivoting in the door opening direction.

In certain embodiments, the opening lever 210 is configured that a pawl lever 220 is coaxially connected thereto and is disposed at an outside position of the opening lever 210 (outside) to pivot with the opening lever 210 in the door opening direction in a door unlocked state.

In certain embodiments, the pawl lever 220 is provided in the "L" shape about a third rotary shaft 223 and is coaxially connected to the second rotary shaft 213 of the opening lever 210. In certain embodiments, a pawl 222 integrally protrudes from the upper side of an end of the pawl lever 220 and a door opening pushing-back end 224 integrally extends from the lower side of the third rotary shaft 223 of the other end and matches with the door locking and unlocking slot 214.

In certain embodiments, the length of the door locking and unlocking slot 214 of the opening lever 210 is longer than that of the door opening pushing-back end 224 of the pawl lever 220 in order to, as described later, prevent the pawl lever 220 from pivoting in the door opening direction in the door locked state.

In certain embodiments, a first return spring 216 is mounted between a side end of the opening lever 210 and a wall of a latch housing (not shown) to provide a resilient force such that the opening lever 210 returns to its original position after pivoting in the door opening direction.

In certain embodiments, a second return spring 226 is mounted around the third rotary shaft 223 of the pawl lever 220 to provide a resilient force such that the pawl lever 220 returns to its original position after pivoting in the door opening direction.

According to the door latch assembly of certain embodiments of the present invention, a door locking and unlocking device 230 is mounted above the opening lever 210 and inside the pawl lever 220 such that three more levers are combined to pivot.

In certain embodiments, the door locking and unlocking device 230 allows only the opening lever 210 to pivot in the door locked state and the opening lever 210 and the pawl lever 220 to pivot in the door opening direction in the door unlocked state.

In certain embodiments, the door locking and unlocking device 230 includes a first locking lever 231 pivoting when a door lock switch is turned on/off, a second locking lever 232 pivoting in association with the first locking lever 231, and a locking linkage 233 linearly moving up and down during the pivoting of the second locking lever 232.

In certain embodiments, the first locking lever 231 pivots in the door locking and unlocking direction along the rotation direction of an actuator (not shown) when the actuator is driven as a driver turns the door lock switch on/off.

In certain embodiments, the first locking lever 231 is formed with a restricting recess 234, formed at the upper end, into which an end of the second locking lever 232 is inserted.

In certain embodiments, the second locking lever 232 is disposed perpendicularly to the first locking lever 231, its end is inserted into the restricting recess 234 of the first locking lever 231, a locking linkage elevation range-restricting slot 235, so that the second locking lever 232 pivots with the first locking lever 231 in the door locking and unlocking direction.

In certain embodiments, the locking linkage 233 has a vertically disposed bar-shaped linkage. In certain embodiments, the upper end of the locking linkage 233 is connected to the other end of the second locking lever 232 and the lower end thereof is inserted into only the door locking and unlocking slot 214 of the opening lever 210 in the door locked state or is inserted into the door locking and unlocking slot 214 in the door unlocked state and simultaneously is in close contact with and bent by the door opening pushing-back end 224 of the pawl lever 220.

In certain embodiments, the upper end of the locking linkage 233 is integrally formed with a first pin 236 inserted into the locking linkage elevation range-restricting slot 235 and the lower end is integrally formed with a second pin 237 that is inserted into only the door locking and unlocking slot 214 in the door locked state and is inserted into the door locking and unlocking slot 214 and simultaneously is in close contact with and bent by the door opening pushing-back end 224 of the pawl lever 220.

In certain embodiments, above the pawl lever 220 and outside the door locking and unlocking device 230 (outdoor), a claw lever 240 is pivotally disposed such that the claw lever 240 is restricted by the pawl lever 220 to lock a striker 250 when the door is closed and that the claw lever 240 is released from the pawl lever 220 and pivots to release the striker 250 when the door is opened.

In certain embodiments, the claw lever 240 is configured that a claw 242 integrally protrudes from the lower side of the claw lever 240 to prevent from pivoting in the door opening direction by being locked by the pawl 222 of the pawl lever 220 and that a striker restricting slot 244, into which the striker 250 integrally formed with a door side frame is inserted, is formed at the directly side of the claw 242.

In certain embodiments, a third return spring 246 is mounted around the rotary shaft of the claw lever 240 to provide a resilient force such that the claw lever 240 pivots in the opening direction.

As such, in certain embodiments, the outer handle lever 200 connected to the door outside handle is mounted at the utmost inside in the door panel and the opening lever 210 and the pawl lever 220, and the first and second levers 231 and 232, which are in association with the outer handle lever 200, are arranged to overlap each other while protecting the outer handle lever 200, so that the shock caused by the side collision is blocked from being transferred to the outer handle lever 200, resulting in easily preventing the outer handle lever from pivoting and being opened in the door opening direction due to the shock at the side collision and the inertial force.

Here, operations of the door latch assembly of a vehicle according to an embodiment of the present invention will be described.

Door Locked State

FIGS. 8 and 9 are a perspective view and a side view showing a locked state of the door latch assembly of a vehicle according to the embodiment of the present invention, respectively.

In certain embodiments, when a driver turns a door lock switch on, the first locking lever 231 pivots in the door locking direction due to the driven actuator and the second locking lever 232 pivots in the door locking direction by the first locking lever 231.

In this case, in certain embodiments, the other end of the second locking lever 232 pivots downwardly to lower the locking linkage 233.

That is, in certain embodiments, the first pin 236 of the locking linkage 233 is restricted by and inserted into the locking linkage elevation range-restricting slot 235 of the second locking lever 232 to descend and the second pin 237 is inserted into only the door locking and unlocking slot 214 of the opening lever 210 lowers the door opening pushing-back end 224 of the pawl lever 220 to a position not to be pushed back.

Due to the descending of the locking linkage 233, in certain embodiments, the second pin 237 is not in close contact with the door opening pushing-back end 224 to push back but is inserted into only the door locking and unlocking slot 214 of the opening lever 210, resulting in the door locked state.

Thus, in certain embodiments, outside a vehicle, the door outside handle is pulled back in the opening direction and the cable is also pulled back, and thus as shown in a view of FIG. 8 showing a state after operation, the outer handle lever 200 connected to the cable pivots in the opening direction.

Next, in certain embodiments, as the pressing end 202 of the outer handle lever 200 presses the pressing end 212 of the opening lever 210, the opening lever 210 pivots in the door opening direction.

In this case, in certain embodiments, though the opening lever 210 pivots in the door opening direction, since the second pin 237 of the locking linkage 233 is not in close contact with the door opening pushing-back end 224 of the pawl lever 220 to push back but is inserted into only the door locking and unlocking slot 214 of the opening lever 210, only the locking linkage 233 pivots when the opening lever 210 pivots in the door opening direction but the pawl lever 220 does not move for the substantial door opening.

Figure 12:
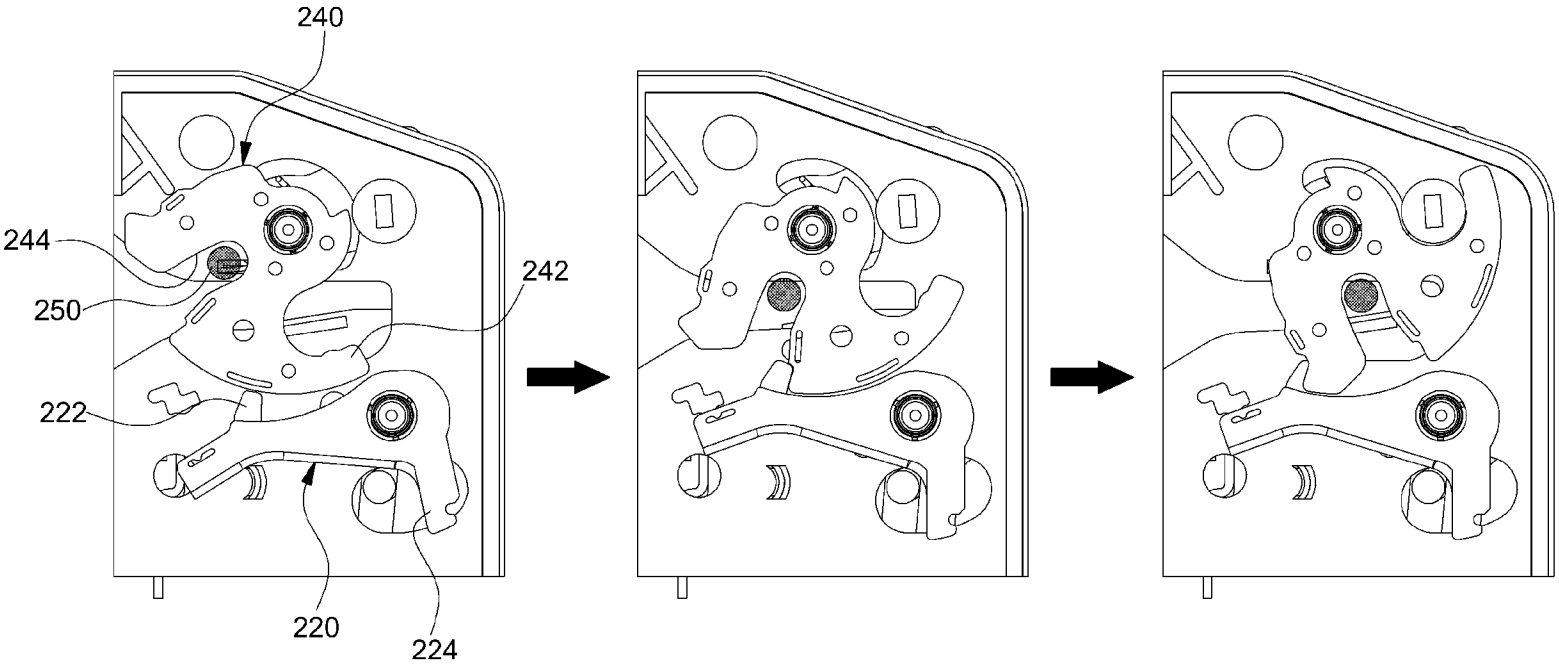
FIG. 12 is a rear side view showing arrangement of a pawl lever and a claw lever of the door latch assembly according to the embodiment of the present invention.

By doing so, in certain embodiments, as shown in FIG. 12, the pawl lever 220 has to operate for the door opening does not pivot and the claw 242 of the claw lever 240 is locked and restricted by the pawl 222 of the pawl lever 220, the door may be prevented from being opened even when the door outside handle is manipulated in the door locked state.

Door Unlocked State

FIGS. 10 and 11 are a perspective view and a side view showing an unlocked state of the door latch assembly of a vehicle according to the embodiment of the present invention, respectively.

When a driver turns the door lock switch off, in certain embodiments, the first locking lever 231 pivots in the door unlocking direction due to the driving actuator and the second locking lever 232 pivots in the door unlocking direction by the first locking lever 231.

In this case, in certain embodiments, the other end of the second locking lever 232 pivots upward to elevate the locking linkage 233.

That is, in certain embodiments, the first pin 236 of the locking linkage 233 is restricted by and inserted into the locking linkage elevation range-restricting slot 235 of the second locking lever 232 to ascend and the second pin 237 is inserted into only the door locking and unlocking slot 214 of the opening lever 210 and ascends to the position to be pushed back in close contact with the door opening pushing-back end 224 of the pawl lever 220.

As the locking linkage 233 ascends, in certain embodiments, the second pin 237 is inserted into the door locking and unlocking slot 214 of the opening lever 210 and in close contact with the door opening pushing-back end 224 of the pawl lever 220 to be pushed back, resulting in the door unlocked state.

Thus, in certain embodiments, outside a vehicle, the door outside handle is pulled back in the opening direction and the cable is also pulled back, and as shown in a view of FIG. 10 showing a state after operation, the outer handle lever 200 connected to the cable pivots in the opening direction.

Next, in certain embodiments, as the pressing end 202 of the outer handle lever 200 presses the pressing end 212 of the opening lever 210, the opening lever 210 pivots in the door opening direction.

In this case, in certain embodiments, when the opening lever 210 pivots in the door opening direction, since the second pin 237 of the locking linkage 233 is inserted into only the door locking and unlocking slot 214 of the opening lever 210 and pushes the door opening pushing-back end 224 of the pawl lever 220 back in the door opening direction.

Since, in certain embodiments, the pawl lever 220 pivots in the door opening direction, as shown in FIG. 12, the claw 242 of the claw lever 240 locked by the pawl 222 of the pawl lever 220 is released, and at the same time the claw lever 240 pivots in the door opening direction due to resilient restoring force of the third return spring 246 so that the striker restricting slot 244 of the claw lever 240 is opened inward such that the door may be opened.

Thus, in certain embodiments, when a user outside a vehicle continues to pull out the door outside handle in the door opening direction, the door is opened as the striker 250 integrally formed with the door side frame is separated from the striker restricting slot 244 of the claw lever 240.

As such, in certain embodiments, the outer handle lever connected to the door outside handle is mounted at the utmost inside of the door panel so that the door may be prevented from being opened at the side collision. The opening lever, the pawl lever, the locking lever, and the locking linkage in association with the outer handle lever are arranged in new structures so that the door may be easily opened and closed in the door locked and unlocked states.

Although embodiments of the present invention have been described in detail, the scope of the present invention is not limited to the description but various modifications made by those skilled in the art using the basic concept of the present invention defined by the claims also fall within the scope of the present invention.

What is claimed is:

1. A door latch assembly of a door of a vehicle, the door latch assembly comprising:

An outer handle lever connected to a door outside handle by a cable and pivotally mounted in an inner position in a door panel;

an opening lever pivotally disposed at an outer position relative to the outer handle lever substantially perpendicularly to the outer handle lever and configured to pivot in a door opening direction when the outer handle lever pivots;

a pawl lever coaxially connected to the opening lever and disposed at an outer position relative to the opening lever, the pawl lever configured to pivot with the opening lever in the door opening direction in a door unlocked state;

a door locking and unlocking device pivotally disposed at an upper position relative to the opening lever and at an inner position relative to the pawl lever and configured to pivot the opening lever and the pawl lever in the door unlocked state in the door opening direction;

a claw lever pivotally disposed at an upper position relative to the pawl lever and an outer position relative to the door locking and unlocking device; and a striker, wherein the claw lever is restricted by the pawl lever to lock the striker when the door is locked and is released from the pawl lever to release the striker when the door is opened.

2. The door latch assembly of claim 1, wherein the outer handle lever is disposed in a substantially utmost inner position in the door panel and is configured to pivot in the same direction as a width direction of the door panel.

3. The door latch assembly of claim 1, further comprising: an inside handle;

a first rotary shaft, the outer handle lever configured to pivot about the first rotary shaft; and an inside handle lever connected to the inside handle and coaxially connected to the first rotary shaft.

4. The door latch assembly of claim 1, wherein the outer handle lever has opposing front and rear ends, the cable is connected to the rear end of the outer handle lever for the connection with the door outside handle and a pressing end configured to press an end of the opening lever down is integrally formed with the front end of the outer handle lever.

5. The door latch assembly of claim 1, wherein the opening lever is provided in the form of an "L"-shape about a second rotary shaft and includes a planar pressing end pressed by the outer handle lever integrally formed with an end of the opening lever and a door locking and unlocking slot formed in the lower side of the other end below the second rotary shaft.

6. The door latch assembly of claim 1, wherein the pawl lever is provided in the form of an "L"-shape about a third rotary shaft and is coaxially connected to a second rotary shaft of the opening lever, the pawl lever having opposing first and second ends and including a pawl integrally protruding from an upper side of the first end of the pawl lever and a door opening pushing-back end integrally extending from the second end of the pawl lever towards a lower side of the third rotary shaft, the pawl configured to restrict a claw of the claw lever.

7. The door latch assembly of claim 1, wherein the opening lever has a door locking and unlocking slot formed therein, the pawl lever has a door opening pushing-back end extending in a length direction of the door locking and unlocking slot of the opening lever, and the door locking and unlocking device comprises:

a first locking lever configured to pivot in a door locking direction or in a door unlocking direction due to an actuator which is driven when a door lock switch is turned on or off;

a second locking lever arranged substantially perpendicularly to the first locking lever, the second locking lever having opposing first and second ends, the first end connected to the first locking lever and the second end having a locking linkage elevation range-restricting slot formed therein, the second locking lever configured to pivot with the first locking lever in the door opening direction to lock or unlock the door; and a locking linkage having an upper end connected to the second end of the second locking lever and a lower end inserted into the door locking and unlocking slot of the opening lever, the lower end configured to selectively contact the door opening pushing-back end of the pawl lever.

8. The door latch assembly of claim 7, wherein the first locking lever has an upper end having a restricting recess formed therein, and the first end of the second locking lever is inserted into the restricting recess.

9. The door latch assembly of claim 7, wherein the locking linkage includes a first pin integrally formed with the upper end and inserted into the locking linkage elevation range-restricting slot and a second pin integrally formed with the lower end, the second pin inserted into the door locking and unlocking slot of the opening lever and configured to selectively contact the door opening pushing-back end of the pawl lever.

10. The door latch assembly of claim 7, wherein the door locking and unlocking slot of the opening lever is longer than the door opening pushing-back end of the pawl lever.

11. The door latch assembly of claim 1, further comprising a first return spring mounted between the opening lever and a latch housing to provide a resilient restoring force returning the opening lever toward its original position after the opening lever pivots in the door opening direction.

12. The door latch assembly of claim 1, further comprising a second return spring mounted around a rotary shaft of the pawl lever to provide a resilient restoring force returning the pawl lever toward its original position after the pawl lever pivots in the door opening direction.

13. The door latch assembly of claim 1, further comprising a third return spring mounted around a rotary shaft of the claw lever to provide a resilient restoring force pivoting the claw lever in in the opposite direction of the door opening direction.

* * * * *